US012448661B2

(12) United States Patent
Moulin et al.

(10) Patent No.: US 12,448,661 B2
(45) Date of Patent: Oct. 21, 2025

(54) VERY HIGH-STRENGTH, COLD-ROLLED, DUAL STEEL SHEETS

(71) Applicant: ArcelorMittal, Luxembourg (LU)

(72) Inventors: Antoine Moulin, Woippy (FR); Veronique Sardoy, Saint Julien Metz (FR); Catherine Vinci, Jury (FR); Gloria Restrepo Gacess, Salon de Provence (FR); Tom Watershoot, Lokeren (BE); Mohamed Goune, Pont a Mousson (FR)

(73) Assignee: ArcelorMittal, Luxembourg (LU)

( * ) Notice: Subject to any disclaimer, the term of this patent is extended or adjusted under 35 U.S.C. 154(b) by 465 days.

(21) Appl. No.: 16/213,455

(22) Filed: Dec. 7, 2018

(65) Prior Publication Data

US 2019/0106765 A1 Apr. 11, 2019

Related U.S. Application Data

(60) Division of application No. 15/097,039, filed on Apr. 12, 2016, now Pat. No. 10,190,187, which is a (Continued)

(30) Foreign Application Priority Data

May 21, 2008 (EP) ..... 08290474

(51) Int. Cl.
*C21D 9/46* (2006.01)
*B22D 7/00* (2006.01)
(Continued)

(52) U.S. Cl.
CPC ..... *C21D 9/46* (2013.01); *B22D 7/00* (2013.01); *B22D 11/001* (2013.01); *C21D 1/84* (2013.01);
(Continued)

(58) Field of Classification Search
CPC ..... C21D 1/84; C21D 6/004; C21D 6/005; C21D 6/008; C21D 8/0205; C21D 8/0226;
(Continued)

(56) References Cited

U.S. PATENT DOCUMENTS 5,545,269 A 8/1996 Koo et al.
5,545,270 A 8/1996 Koo et al.
(Continued)

FOREIGN PATENT DOCUMENTS

EP 0796928 A1 9/1997
EP 1201780 A1 5/2002
(Continued)

OTHER PUBLICATIONS

Arnold R. Marder, Effects of Surface Treatments on Materials Performance, Materials Selection and Design, vol. 20, ASM Handbook, Edited By George E. Dieter, ASM International, 1997, p. 470-490, https://doi.org/10.31399/asm.hb.v20.a0002466 (Year: 1997).*
(Continued)

*Primary Examiner* — Nicholas A Wang
(74) *Attorney, Agent, or Firm* — Davidson Kappel LLC

(57) ABSTRACT

The present invention provides a cold-rolled and annealed Dual-Phase steel sheet having a tensile strength from 980 to 1100 MPa. The composition includes the contents being expressed by weight: 0.055%≤C≤0.095%, 2%≤Mn≤2.6%, 0.005%≤Si≤0.35%, S≤0.005%, P≤0.050%, 0.1≤Al≤0.3%, 0.05%≤Mo≤0.25%, 0.2%≤Cr≤0.5%, Cr+2 Mo≤0.6%, Ni≤0.1%, 0.010≤Nb≤0.040%, 0.010≤Ti≤0.050%, 0.0005≤B≤0.0025%, and 0.002%≤N≤0.007%. The remainder of the composition includes iron and inevitable impurities resulting from the smelting. A microstructure of the steel
(Continued)

sheet is 40 to 65% ferrite, 35 to 50% martensite and 0 to 10% bainite. A non-recrystallized ferrite fraction is less than or equal to 15%.

31 Claims, 2 Drawing Sheets

Related U.S. Application Data continuation of application No. 12/993,498, filed as application No. PCT/FR2009/000574 on May 15, 2009, now abandoned.

(51) Int. Cl.

| | |
|---|---|
| ***B22D 11/00*** | (2006.01) |
| ***C21D 1/84*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C23C 2/02*** | (2006.01) |
| ***C23C 2/06*** | (2006.01) |
| ***C23C 2/28*** | (2006.01) |
| ***C23C 2/36*** | (2006.01) |

(52) U.S. Cl.

CPC ..... *C21D 6/004* (2013.01); *C21D 6/005* (2013.01); *C21D 6/008* (2013.01); *C21D 8/0205* (2013.01); *C21D 8/021* (2013.01); *C21D 8/0226* (2013.01); *C21D 8/0236* (2013.01); *C21D 8/0263* (2013.01); *C21D 8/0273* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C22C 38/48* (2013.01); *C22C 38/50* (2013.01); *C22C 38/54* (2013.01); *C22C 38/58* (2013.01); *C23C 2/02* (2013.01); *C23C 2/0224* (2022.08); *C23C 2/024* (2022.08); *C23C 2/06* (2013.01); *C23C 2/28* (2013.01); *C23C 2/29* (2022.08); *C23C 2/36* (2013.01)

(58) Field of Classification Search

CPC .. C21D 8/0236; C21D 8/0263; C21D 8/0273; C21D 9/46; C22C 38/001; C22C 38/002; C22C 38/02; C22C 38/04; C22C 38/06; C22C 38/44; C22C 38/48; C22C 38/50; C22C 38/54; C22C 38/58; C23C 2/02; C23C 2/06; C23C 2/28; C23C 2/36

See application file for complete search history.

(56) References Cited

U.S. PATENT DOCUMENTS

| | | | | |
|---|---|---|---|---|
| 7,686,896 | B2 | 3/2010 | Yoshida et al. | |
| 7,780,799 | B2 | 8/2010 | Goto et al. | |
| 7,976,647 | B2 | 7/2011 | Moulin et al. | |
| 2003/0091857 | A1 | 5/2003 | Pradhan et al. | |
| 2003/0129444 | A1 | 7/2003 | Matsuoka et al. | |
| 2003/0221752 | A1* | 12/2003 | Utsumi | C22C 38/02 148/334 |
| 2004/0033386 | A1 | 2/2004 | Pradhan et al. | |
| 2004/0238082 | A1* | 12/2004 | Hasegawa | C22C 38/04 148/652 |
| 2005/0139293 | A1 | 6/2005 | Nomura et al. | |
| 2007/0029015 | A1 | 2/2007 | Yoshinaga et al. | |
| 2007/0095444 | A1 | 5/2007 | Nonaka et al. | |
| 2008/0099109 | A1 | 5/2008 | Park | |
| 2008/0118390 | A1 | 5/2008 | Kizu et al. | |
| 2009/0025831 | A1 | 1/2009 | Yamamoto et al. | |
| 2010/0132849 | A1* | 6/2010 | Takagi | C23C 2/28 148/533 |
| 2010/0307644 | A1 | 12/2010 | Gil Otin et al. | |
| 2011/0168300 | A1 | 7/2011 | Moulin et al. | |

FOREIGN PATENT DOCUMENTS

| | | | |
|---|---|---|---|
| EP | 1548142 | A1 | 6/2005 |
| FR | 2790009 | A1 | 8/2000 |
| JP | H11350038 | A | 12/1999 |
| JP | 2000017385 | A | 1/2000 |
| JP | 2005220430 | * | 8/2005 |
| JP | 2005220430 | A | 8/2005 |
| JP | 3793350 | B2 | 7/2006 |
| JP | 2006183131 | A | 7/2006 |
| JP | 2006283128 | A | 10/2006 |
| JP | 2007070659 | A | 3/2007 |
| JP | 2007092126 | A | 4/2007 |
| RU | 2151214 | C1 | 6/2000 |
| RU | 2152450 | C1 | 7/2000 |
| RU | 2190685 | C1 | 10/2002 |
| RU | 2312163 | C2 | 12/2007 |
| RU | 2321667 | C2 | 4/2008 |

OTHER PUBLICATIONS

ASTM international. E415-08 "Standard Test Method for Atomic Emission Vacuum Spectrometric Analysis of Carbon and Low-Alloy Steel." (Year: 2008).*

ASTM international. E1019-08 "Standard Test Methods for Determination of Carbon, Sulfur, Nitrogen, and Oxygen in Steel, Iron, Nickel, and Cobalt Alloys by Various Combustion and Fusion Techniques." (Year: 2008).*

* cited by examiner

VERY HIGH-STRENGTH, COLD-ROLLED, DUAL STEEL SHEETS

CROSS REFERENCE TO RELATED APPLICATIONS

This is a divisional of U.S. application Ser. No. 15/097,039, filed Apr. 12, 2016, which is a continuation of U.S. application Ser. No. 12/993,498 filed on Mar. 11, 2011 which is a national stage of PCT/FR2009/000574 filed on May 15, 2009 which claims priority to EP 08290474.9 filed on May 21, 2008, the entire disclosures of which are hereby incorporated by reference herein.

The invention relates to the manufacture of cold-rolled and annealed sheets from steels known as "dual-phase" which have a very high strength and ductility for the manufacture of parts by shaping, in particular in the automobile industry.

BACKGROUND

Dual-Phase steels, the structure of which comprises martensite, and possibly some bainite, in a ferritic matrix, have become widely used because they combine a high strength with high deformation capacity. As delivered, their yield strength is relatively low compared with their fracture strength, which gives them a very favorable yield strength/strength ratio during forming operations. Their work-hardening ability is very high, which allows good deformation distribution in a collision and produces a much higher yield strength in a part after forming. Thus, parts as complicated as those produced with conventional steels can be made, but with better mechanical properties, which enables a reduction in thickness to meet the same functional specification. In that way, these steels are an effective answer to the requirements of vehicle lightening and safety. In the field of hot-rolled (with a thickness for example of 1 to 10 mm) or cold-rolled (thickness for example of 0.5 to 3 mm) sheets, this type of steel especially finds applications for structural and safety parts for motor vehicles, such as crossmembers, side members, reinforcing parts, or even pressed steel wheels.

Modern requirements for lightening and the reduction of energy consumption have resulted in an increased demand for very high-strength dual-phase steels, that is to say of which the mechanical strength Rm is between 980 and 1100 MPa. In addition to this level of strength, these steels must have good weldability and good continuous hot-dip galvanizing capacity. These steels must also have good bending capacity.

The manufacture of high-strength Dual-Phase steels is for example described in the document EP 1201780 A1 relating to steels having the composition: 0.01-0.3% C, 0.01-2% Si, 0.05-3% Mn, <0.1% P, <0.01% 8, and 0.005-1% Al, of which the mechanical strength is greater than 540 MPa, which have good fatigue strength and hole expansion ratio. However, most of the examples presented in this document exhibit strength less than 875 MPa. The rare examples in this document going beyond this value relate to steels with a high carbon content (0.25 or 0.31%) of which the weldability and the whole expansion ratio are not satisfactory.

The document EP 0796928 A1 also describes cold-rolled Dual-Phase steels of which the strength is greater than 550 MPa, having the composition 0.05-0.3% C, 0.8-3% Mn, 0.4-2.5% Al, and 0.01-0.2% Si. The ferritic matrix contains martensite, bainite and/or retained austenite. The examples presented show that the strength does not exceed 660 MPa, even with high carbon content (0.20-0.21%).

The document JP 11350038 describes Dual-Phase steels of which the strength is greater than 980 MPa, having the composition 0.10-0.15% C, 0.8-1.5% Si, 1.5-2.0% Mn, 0.01-0.05% P, less than 0.005% 8, 0.01-0.07% Al in solution, and less than 0.01% N, also containing one or more of the following elements: 0.001-0.02% Nb, 0.001c0.02% V, 0.001-0.02% Ti. This high strength is obtained however at the expense of a large addition of silicon which of course allows martensite to form, but can nevertheless result in the formation of surface oxides which negatively affect the dip coatability.

BRIEF SUMMARY OF THE INVENTION

An object of the present invention provides a manufacturing method for very high-strength dual-phase steel sheets, cold-rolled, bare or coated, not having the disadvantages mentioned above.

The present invention provides Dual-Phase steel sheets having a mechanical strength between 980 and 1100 MPa together with a breaking elongation greater than 9% and good forming capacity, especially good bending capacity.

The present invention also provides a manufacturing method of which small variations of the parameters do not cause major changes to the microstructure or the mechanical properties.

The present invention further provides a steel sheet easily manufactured by cold-rolling, that is to say of which the hardness after the hot-rolling step is limited in such a way that the rolling strains remain moderate during the cold-rolling step.

The present invention additionally provides a steel sheet on which a metallic coating can be deposited, in particular by hot-dip galvanizing according to the usual methods.

Another objection of the present invention is to provide a steel having good weldability by means of the usual methods of assembling such as by resistance spot welding.

A further objection of the present invention is to provide an economical manufacturing method by avoiding the addition of costly alloying elements.

The present invention provides a cold-rolled and annealed Dual-Phase steel sheet having a strength between 980 and 1100 MPa, and a breaking elongation greater than 9%, of which the composition comprises, the contents being expressed by weight: $0.055\% \leq C \leq 0.095\%$, $2\% \leq Mn \leq 2.6\%$, $0.005\% \leq Si \leq 0.35\%$, $S \leq 0.005\%$, $P \leq 0.050\%$, $0.1 \leq Al \leq 0.3\%$, $0.05\% \leq Mo \leq 0.25\%$, $0.2\% \leq Cr \leq 0.5\%$, it being understood that $Cr+2Mo \leq 0.6\%$, $Ni \leq 0.1\%$, 0.010: $\leq Nb \leq 0.040\%$, 0.010: $\leq Ti: \leq 0.050\%$, $0.0005 \leq B \leq 0.0025\%$, and $0.002\% \leq N \leq 0.007\%$, the remainder of the composition consisting of iron and the inevitable impurities resulting from smelting.

Preferably, the composition of the steel contains, the content being expressed by weight: $0.12\% \leq Al \leq 0.25\%$.

According to a preferred embodiment, the composition of the steel contains, the content being expressed by weight: $0.10\% \leq Si \leq 0.30\%$.

The composition of the steel preferably contains: $0.15\% \leq Si \leq 0.28\%$. According to a preferred embodiment, the composition contains: $P \leq 0.015\%$.

The microstructure of the steel sheet preferably contains a surface area fraction of 35 to 50% martensite.

According to a particular embodiment, the complement of the microstructure consists of a surface area fraction of 50 to 65% ferrite.

According to another particular embodiment, the complement of the microstructure consists of surface area fractions of 1 to 10% bainite and 40 to 64% ferrite.

The non-recrystallized ferrite surface area fraction compared to the whole of the ferritic phase is preferably less than or equal to 15%.

The steel sheet preferably has a ratio of its yield strength Re to its strength Rm such that: $0.6 \leq Re/Rm \leq 1.8$.

According to a particular embodiment, the sheet is continuously galvanized. According to another particular embodiment, the sheet includes a galvannealed coating.

Another subject of the invention is a manufacturing method for a cold-rolled and annealed Dual-Phase steel sheet characterized in that a steel having a composition according to any one of the above specifications is supplied, then:

- the steel is cast as a semi-finished product, then;
- the semi-finished product is brought to a temperature 1150° C.≤TR≤1250° C., then;
- the semi-finished product is hot-rolled with an end-of-rolling temperature $T_{FL} \geq A_{r3}$ to obtain a hot-rolled product, then;
- the hot-rolled product is coiled at a temperature 500° C.≤$T_{bob}$≤570° C., then the hot-rolled product is descaled, then cold-rolling is carried out with a reduction of between 30 and 80% to obtain a cold-rolled product, then;
- the cold-rolled product is heated at a rate 1° C.≤$V_c$≤5° C./s to an annealing temperature $T_M$ such as: Ac1+40° C.≤$T_M$≤Ac3-30° C., at which it is held for a time: 30 s≤$t_M$≤300 s so as to obtain a heated and annealed product with a structure comprising austenite, then;
- the product is cooled to a temperature less than the temperature $M_S$ at a rate V high enough for all of the austenite to transform to martensite.

Another subject of the invention is a manufacturing method for a cold-rolled, annealed and galvanized Dual-Phase steel sheet characterized in that the heated and annealed product with a structure comprising austenite according to the above specification is supplied, then:

- the heated and annealed product is cooled at a rate VR high enough to prevent the transformation of the austenite to ferrite, until a temperature close to the hot-dip galvanizing temperature $T_{Zn}$ is reached, then;
- the product is continuously galvanized by immersion in a bath of zinc or Zn alloy at a temperature 450° C.≤$T_{Zn}$≤480° C. to obtain a galvanized product, then;
- the galvanized product is cooled to the ambient temperature at a rate $V_R$ greater than 4° C./s to obtain a cold-rolled, annealed and galvanized steel sheet.

The present invention also provides a manufacturing method for a cold-rolled and galvannealed Dual-Phase steel sheet, characterized in that the heated and annealed product with a structure comprising austenite according to the above specification is supplied, then:

- the heated and annealed product is cooled at a rate VR high enough to prevent the transformation of said austenite to ferrite, until a temperature close to the hot-dip galvanizing temperature $T_{Zn}$ is reached, then;
- the product is continuously galvanized by immersion in a bath of zinc or Zn alloy at a temperature 450° C.≤$T_{Zn}$≤480° C. to obtain a galvanized product, then;
- the galvanized product is heated at a temperature $T_G$ between 490 and 550° C. for a time $t_g$ between 10 and 40 s to obtain a galvannealed product, then;
- the galvannealed product is cooled to the ambient temperature at a rate V"R greater than 4° C./s, to obtain a cold-rolled and galvannealed steel sheet. Another subject of the invention is a manufacturing method according to one of the above specifications, characterized in that the temperature $T_M$ is between 760 and 830° C.

According to a particular embodiment, the rate of cooling VR is greater than or equal to 15° C./s.

Another subject of the invention is the use of a steel sheet according to any one of the above specifications, or manufactured by a method according to any one of the above specifications, for the manufacture of structural or safety parts for motor vehicles.

BRIEF DESCRIPTION OF THE DRAWINGS

Other features and advantages of the invention will emerge in the course of the description which follows, given as an example and written with reference to the attached figures, in which.

DETAILED DESCRIPTION

Figure 1:
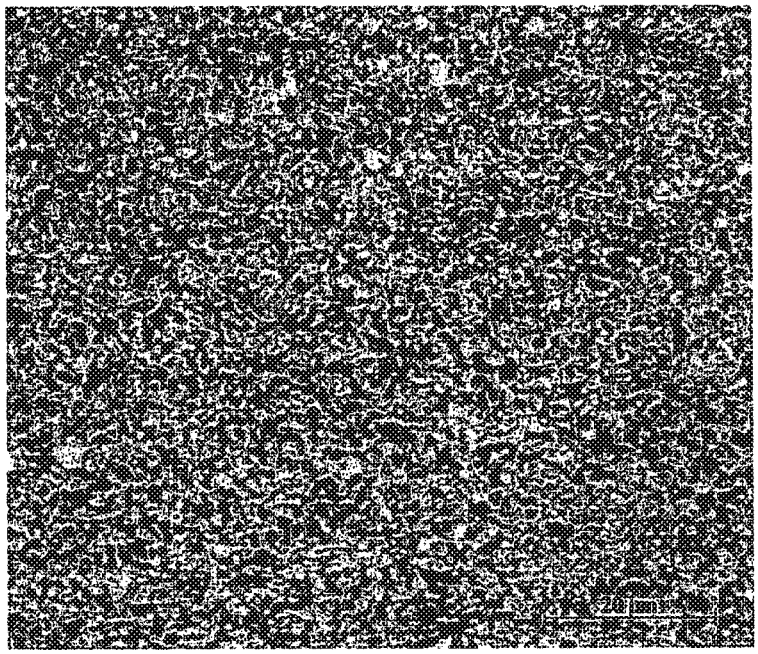
FIG. 1 shows an example of a microstructure of a steel sheet according to the invention.

The invention will now be described in a more precise, but non-limiting manner, by considering its various characteristic elements:

With regard to the chemical composition of the steel, carbon plays an important part in the formation of the microstructure and affects the mechanical properties: below 0.055% by weight, the strength is unsatisfactory. Above 0.095%, an elongation of 9% cannot be guaranteed. The weldability is also reduced.

In addition to a hardening effect due to a solid solution, manganese is an element which increases the hardenability and reduces the precipitation of carbides. A minimum content of 2% by weight is required to obtain the desired mechanical properties. However, above 2.6%, its gamma-iron-forming quality results in the formation of a band structure which is too pronounced.

Silicon is an element which contributes to the deoxidizing of the liquid steel and the hardening in solid solution. This element also plays an important part in the formation of the microstructure by preventing the precipitation of carbides and by promoting the formation of martensite which is a component of the structure of Dual-Phase steels. It has a significant effect above 0.005%.

An addition of silicon in a quantity greater than 0.10%, preferably greater than 0.15%, makes it possible to reach the higher levels of strength sought by the invention. However, an increase in the silicon content reduces the dip-coating capacity by promoting the formation of oxides adhering to the surface of the products: its content must be limited to 0.35% by weight, and preferably 0.30%, to obtain good coatability. Silicon also reduces the weldability: a content less than 0.28% provides very good weldability as well as good coatability at the same time.

Above a sulfur content of 0.005%, the ductility is reduced due to the presence of excess sulfides such as MnS which reduce the ductility, in particular during hole expansion tests.

Phosphorus is an element which hardens in solid solution but which reduces the spot weldability and the hot ductility, particularly due to its tendency to segregation at the grain boundaries or co-segregation with manganese. For these reasons, its content must be limited to 0.050%, and preferably 0.015%, in order to obtain good spot weldability.

Aluminum plays an important part in the invention by preventing the precipitation of carbides and by promoting the formation of martensitic components on cooling. These effects are obtained when the aluminum content is greater than 0.1%, and preferably when the aluminum content is greater than 0.12%.

As AlN, aluminum limits the grain growth during annealing after cold-rolling.

This element is also used for deoxidizing the liquid steel in a quantity usually less than approximately 0.050%. In fact it is generally thought that higher contents increase the erosion of the refractories and the risk of blocking the nozzles. In excessive amounts, aluminum reduces the hot ductility and increases the risk of defects appearing in continuous casting. An effort is also made to limit inclusions of alumina, in particular in the form of clusters, with the aim of ensuring satisfactory elongation properties. The inventors have demonstrated that, in combination with the other elements of the composition, a quantity of aluminum up to 0.3% by weight could be added without any negative effect on the other properties required, in particular with regard to the ductility, and would also make it possible to obtain the microstructural and mechanical properties sought. Above 0.3%, there is a risk of interaction between the liquid metal and the slag during continuous casting, which may result in the appearance of defects. Aluminum content up to 0.25% by weight ensures the formation of a fine microstructure without large martensitic islands which would have a negative effect on the ductility.

The inventors have shown that, surprisingly, it was possible to obtain a high level of strength, between 980 and 1100 MPa, even in spite of limiting additions of aluminum and silicon. This is obtained by the particular combination of alloying or micro-alloying elements according to the invention, in particular by means of additions of Mo, Cr, Nb, Ti, and B.

In a quantity greater than 0.05% by weight, molybdenum has a positive effect on the hardenability and retards the growth of ferrite and the appearance of bainite. However, content greater than 0.25% excessively increases the cost of the additions.

In a quantity greater than 0.2%, chromium, due to its effect on the hardenability, also contributes to retarding the formation of proeutectoid ferrite. Above 0.5%, the cost of the addition is once again excessive.

The combined effects of chromium and molybdenum on the hardenability are taken into account in the invention according to their individual characteristics; according to the invention, the chromium and molybdenum contents are such that $Cr+(2\times Mo)\leq 0.6\%$. The coefficients in this relationship indicate the respective influences of these two elements on the hardenability for the purpose of promoting the production of a fine ferritic structure.

Titanium and niobium are micro-alloying elements used together according to the invention:

- in a quantity between 0.010 and 0.050%, titanium combines mainly with nitrogen and carbon to precipitate as nitrides and/or carbonitrides. These precipitates are stable when the slabs are heated to 1150-1250° C. before hot-rolling, which makes it possible to control the austenite grain size. Above a titanium content of 0.050%, there is a risk of forming coarse nitrides of titanium which precipitate from the liquid state, and which tend to reduce the ductility;
- in a quantity greater than 0.010%, niobium is very effective for forming fine precipitates of Nb(CN) in the austenite or the ferrite during hot-rolling, or again during annealing in a temperature range near the intercritical transformation range. It retards recrystallization during hot-rolling and during annealing and refines the microstructure. However, since excessive niobium content reduces weldability, it should be limited to 0.040%.

The above titanium and niobium contents make it possible to arrange that nitrogen is completely trapped as nitrides or carbonitrides, so much so that boron occurs in the free state and can have a positive effect on the hardenability. The effect of boron on hardenability is crucial. By limiting the activity of carbon, boron in fact makes it possible to control and limit the diffusive phase transformations (ferrite or pearlite transformation during cooling) and to form the hardening phases (bainite or martensite) required for obtaining high mechanical strength characteristics. The addition of boron is therefore an important component of the present invention, and it also makes it possible to limit the addition of hardening elements such as Mn, Mo, and Cr and reduce the cost of the steel grade.

The minimum boron content to provide useful hardenability is 0.0005%. Above 0.0025%, the effect on the hardenability peaks and a negative effect on the coatability and the hot ductility are observed.

In order to form a satisfactory quantity of nitrides and carbonitrides, a minimum nitrogen content of 0.002% is required. The nitrogen content is limited to 0.007% to prevent the formation of BN which would reduce the quantity of free boron required for the hardening of the ferrite.

An optional addition of nickel can be made so as to obtain extra hardening of the ferrite. This addition is however limited to 0.1% for cost reasons.

The implementation of the manufacturing method for a rolled sheet according to the invention includes the following successive steps:

- a steel having a composition according to the invention is supplied; and
- the casting of a semi-finished product is carried out starting with this steel. This casting can be made in ingots or continuously as slabs having a thickness of the order of 200 mm. The casting can also be carried out as thin slabs a few tens of millimeters thick or in thin strips between contra-rotating steel cylinders.

The cast semi-finished products are first brought to a temperature $T_R$ greater than 1150° C. so that at every point they reach a favorable temperature for the large deformations that the steel will undergo during rolling.

However, if the temperature $T_R$ is too high, the austenite grains grow in an undesirable manner. In this temperature range, the only precipitates that can effectively control the austenite grain size are the nitrides of titanium, and the heating temperature should be limited to 1250° C. in order to maintain a fine austenite grain size at this stage.

Of course, in the case of direct casting of thin slabs or thin strips between contra-rotating cylinders, the hot-rolling step for these semi-finished products starting at more than 1150° C. can be done directly after casting so that an intermediate heating step is not required in this case.

The semi-finished product is hot-rolled in a temperature range in which the structure of the steel is fully austenitic: if $T_{FL}$ is less than the start temperature of austenite transformation on cooling $A_{r3}$, the ferrite grains are work-hardened by the rolling and the ductility is reduced. Preferably, an end-of-rolling temperature greater than 850° C. will be selected.

The hot-rolled product is next coiled at a temperature $T_{bob}$ between 500 and 570° C.: this temperature range makes it possible to obtain a complete bainite transformation during the nearly isothermal holding time associated with coiling. This range results in morphology of Ti and Nb precipitates which is fine enough to make use of their hardening power during later steps of the manufacturing method. A coiling temperature greater than 570° C. results in the formation of coarser precipitates, of which the coalescence during continuous annealing significantly reduces the effectiveness.

When the coiling temperature is too low, the hardness of the product is increased, which increases the force required during later cold-rolling.

Next the hot-rolled product is descaled using a method known in its own right, and then a cold-rolling is carried out with a reduction of preferably between 30 and 80%.

Next the cold-rolled product is heated, preferably in a continuous annealing plant, at an average rate of heating $V_C$ between 1 and 5° C./s. Combined with the annealing temperature $T_M$ below, this rate of heating range produces a non-recrystallized ferrite fraction less than or equal to 15%.

The heating is carried out at an annealing temperature $T_M$ between the temperature $A_{c1}$ (start temperature of allotropic transformation on heating)+40° C., and $A_{c3}$ (end temperature of allotropic transformation on heating)−30° C., that is to say in a specific temperature range within the intercritical range: when $T_M$ is less than (Ac1+40° C.), the structure can also include zones of non-recrystallized ferrite of which the surface area fraction can reach 15%. This non-recrystallized ferrite fraction is calculated in the following manner: having identified the ferritic phase in the microstructure, the non-recrystallized ferrite surface area percentage compared with the whole of the ferritic phase is quantified. The inventors have demonstrated that these non-recrystallized zones have a negative effect on the ductility and do not make it possible to obtain the characteristics sought by the invention. An annealing temperature $T_M$ according to the invention produces enough austenite to form martensite later on cooling in such a quantity that the desired characteristics are achieved. A temperature $T_M$ less than ($A_{c3}$−30° C.) also ensures that the carbon content of the islands of austenite formed at the temperature $T_M$ does in fact result in a later martensite transformation: when the annealing temperature is too high, the carbon content of the islands of austenite becomes too low, which results in a later unfavorable transformation to bainite or pearlite. What is more, too high a temperature results in an increase in the size of the niobium precipitates which lose part of their hardening capacity. The final mechanical strength is then reduced.

To this end, a temperature $T_M$ between 760° C. and 830° C. will preferably be selected.

A minimum holding time $t_M$ of 30 s at the temperature $T_M$ allows the carbides to dissolve, and a partial transformation to austenite occurs. After a time of 300 s the effect peaks. A holding time greater than 300 s is also hardly compatible with the productivity requirements of continuous annealing plants, in particular the pass speed. The holding time $t_M$ is between 30 and 300 s.

The following steps of the method differ according to whether uncoated steel sheet, or continuous hot-dip galvanized steel sheet, or galvannealed steel sheet is being manufactured:

in the first case, at the end of the annealing holding time, cooling to a temperature less than the temperature $M_S$ (start temperature of martensite formation) is carried out at a rate of cooling V high enough for all the austenite formed during annealing to transform to martensite.

This cooling can be carried out starting from the temperature $T_M$ in one or more steps and can use in the latter case various cooling methods such as cold or boiling water baths, water or gas jets. These possible accelerated cooling methods can be combined so as to obtain a complete transformation of austenite to martensite. After this martensite transformation, the steel sheet is cooled to the ambient temperature.

The microstructure of the cooled bare sheet then consists of a ferritic matrix with islands of martensite of which the surface area fraction is between 35 and 50%, and which is free of bainite.

If it is desired to manufacture a continuous hot-dip galvanized sheet, at the end of the annealing holding time, the product is cooled until a temperature close to the hot-dip galvanizing temperature $T_{Zn}$ is reached, the rate of cooling $V_R$ being rapid enough to prevent the transformation of austenite to ferrite. To this end, the rate of cooling $V_R$ is preferably greater than 15° C./s. Hot-dip galvanizing is carried out by immersion in a bath of zinc or zinc alloy of which the temperature $T_{Zn}$ is between 450 and 480° C. A partial transformation of the austenite to bainite occurs at this stage, which results in the formation of 1 to 10% bainite, this value being expressed as a surface area fraction. The holding time in this temperature range must be less than 80 s so as to limit the surface area fraction of bainite to 10% and thus obtain a satisfactory martensite fraction. The galvanized product is next cooled at a rate between $V'_R$ greater than 4° C./s to the ambient temperature with the aim of completely transforming the remaining austenite fraction to martensite: in this way a cold-rolled, annealed and galvanized steel sheet containing surface area fractions of 40-64% ferrite, 35-50% martensite and 1-10% bainite is obtained.

If it is desired to manufacture a cold-rolled and "galvannealed," that is to say alloy-galvanized, Dual-Phase steel sheet, the product is cooled at the end of the annealing holding time until a temperature close to the hot-dip galvanizing temperature $T_{Zn}$ is reached, the rate of cooling $V_R$ being rapid enough to prevent the transformation of the austenite to ferrite. To this end, the rate of cooling $V_R$ is preferably greater than 15° C./s. The hot-dip galvanizing is carried out by immersion in a bath of zinc or zinc alloy of which the temperature $T_{Zn}$ is between 450 and 480° C. A partial transformation of the austenite to bainite occurs at this stage, which results in the formation of 1 to 10% bainite, this value being expressed as a surface area fraction. The holding time in this temperature range must be less than 80 s so as to limit the bainite fraction to 10%. After it leaves the bath of zinc, the galvanized product is heated to a temperature $T_G$ between 490 and 550° C. for a time $t_8$ between 10 and 40 s. This causes the interdiffusion of the iron and the fine layer of zinc or zinc alloy deposited during immersion, which produces a galvannealed product. This product is cooled to the ambient temperature at a rate $V''_R$ greater than 4° C./s: in this way a galvannealed steel sheet with a ferritic matrix, containing surface area fractions of 40-64% ferrite, 35-50% martensite and 1-10% bainite is obtained. The martensite is generally in the form of islands of average size less than four microns, even two microns, most of these islands-more than 50% of them-having a massive morphology rather than an elongated morphology. The morphology of a given island is characterized by the ratio of its maximum dimension $L_{max}$ to its minimum dimension $L_{min}$. A given island is considered to have a massive morphology when its ratio $L_{max}/L_{min}$ is less than or equal to 2.

The inventors have also observed that small variations of the manufacturing parameters, in the conditions defined according to the invention, do not cause major changes to the microstructure or the mechanical properties, which is an advantage for the stability of the characteristics of the industrial products manufactured.

The present invention will now be illustrated using the following examples given in a non-limiting way:

EXAMPLE

Steels were produced with the composition shown in the table below, expressed in percentages by weight. In addition to the steels IX to IZ used for the manufacture of sheets according to the invention, the composition of a steel R used for the manufacture of reference sheets is shown by way of comparison.

TABLE 1

Steel compositions (% weight).

| Steel | C (%) | Mn (%) | Si (%) | S (%) | P (%) | Al (%) | Mo (%) | Cr (%) | Cr + 2Mo (%) | Ni (%) | Nb (%) | Ti (%) | B (%) | N (%) |
|---|---|---|---|---|---|---|---|---|---|---|---|---|---|---|
| IX | 0.071 | 2.498 | 0.275 | 0.003 | 0.011 | 0.150 | 0.104 | 0.304 | 0.512 | 0.022 | 0.039 | 0.025 | 0.0024 | 0.004 |
| IY | 0.076 | 2.430 | 0.3 | 0.003 | 0.012 | 0.120 | 0.09 | 0.33 | 0.51 | 0.030 | 0.024 | 0.024 | 0.0018 | 0.0035 |

TABLE 1-continued

Steel compositions (% weight).

| Steel | C (%) | Mn (%) | Si (%) | S (%) | P (%) | Al (%) | Mo (%) | Cr (%) | Cr + 2Mo (%) | Ni (%) | Nb (%) | Ti (%) | B (%) | N (%) |
|---|---|---|---|---|---|---|---|---|---|---|---|---|---|---|
| IZ | 0.062 | 2.030 | 0.153 | 0.003 | 0.011 | 0.125 | 0.055 | 0.27 | 0.38 | 0.020 | 0.011 | 0.015 | 0.0011 | 0.004 |
| R | 0.143 | 1.910 | 0.23 | 0.002 | 0.012 | 0.035 | 0.1 | 0.24 | 0.44 | — | — | — | — | 0.004 |

R = Reference.
Values underlined: Not according to the invention.

Cast semi-finished products corresponding to the compositions above were heated to 1230° C. then hot-rolled to a thickness of 2.8-4 mm in a temperature range in which the structure is entirely austenitic. The manufacturing conditions of these hot-rolled products (end-of-rolling temperature TFL, coiling temperature $T_{bob}$) are shown in table 2.

TABLE 2

Manufacturing conditions of hot-rolled products

| Steel | $T_{FL}$ (° C.) | $A_{r3}$ (° C.) | $T_{bob}$ (° C.) |
|---|---|---|---|
| IX | 890 | 705 | 530 |
| IY | 880 | 715 | 540 |
| IZ | 880 | 735 | 530 |
| R | 880 | 700 | 550 |

The hot-rolled products were next descaled then cold-rolled to a thickness of 1.4 to 2 mm which is a reduction of 50%. Starting with the same composition, some steels were subjected to different manufacturing conditions. The references IX1, IX2 and IX3 designate for example three steel sheets manufactured under different conditions starting with the steel composition IX. The sheets were hot-dip galvanized in a bath of zinc at a temperature TZN of 460° C., others were also subjected to galvannealing treatment. Table 3 shows the manufacturing conditions of the sheets annealed after cold-rolling:

Rate of heating $V_C$

Annealing temperature $T_M$

Annealing holding time $t_M$

Rate of cooling after annealing $V_R$ Rate of cooling after galvanizing $V'_R$ Galvannealing temperature $T_G$ Galvannealing time $t_G$ Rate of cooling $V''_R$ after galvannealing treatment.

The transformation temperatures $A_{c1}$ and $A_{c3}$ have also been entered in table 3.

TABLE 3

Manufacturing conditions of cold-rolled and annealed sheets

| Steel sheet | $V_C$ (° C./s) | $T_M$ (° C.) | $A_{c1}$-$A_{c3}$ (° C.) | $t_M$ (s) | $V_R$ (° C./s) | $V'_R$ (° C./s) | $T_G$ (° C.) | $t_G$ (s) | V"R (° C./s) |
|---|---|---|---|---|---|---|---|---|---|
| IX1 Invention | 2 | 800 | 710-870 | 90 | 20 | 18 | — | — | — |
| IX2 Invention | 2 | 780 | 710-870 | 90 | 20 | 18 | — | — | — |
| IX3 Reference | 2 | 740 | 710-870 | 100 | 17 | 15 | — | — | — |
| IX4 Invention | 2 | 800 | 710-870 | 100 | 20 | — | 520 | 10 | 10 |
| IX5 Reference | 2 | 850 | 710-870 | 100 | 20 | — | 520 | 10 | 10 |
| IX6 Reference | 2 | 745 | 710-870 | 100 | 20 | — | 520 | 10 | 10 |
| IX7 Reference | 2 | 800 | 710-870 | 100 | 10 | — | 520 | 10 | 10 |
| IY1 Example | 2 | 780 | 710-865 | 90 | 20 | 18 | — | — | — |
| IY2 Example | 2 | 800 | 710-865 | 100 | 20 | — | 520 | 10 | 10 |
| IZ Example | 2 | 800 | 710-865 | 100 | 20 | — | 520 | 10 | 10 |
| R Reference | 2 | 800 | 715-810 | 90 | 20 | 18 | — | — | — |

Values underlined: not according to the invention

The tensile mechanical properties obtained (yield strength Re, strength Rm, breaking elongation A) have been entered in table 4 below. The ratio Re/Rm is also shown.

The microstructure of the steels, of which the matrix is ferritic, has also been determined. The surface area fractions of bainite and martensite have been quantified after attack with Picral and LePera reagents respectively, followed by image analysis using Aphelion™ software. The surface area fraction of non-recrystallized ferrite was also determined using optical microscopy and scanning electronic microscopy observations in which the ferritic phase was identified, then the recrystallized fraction in this ferritic phase was quantified.

The non-recrystallized ferrite occurs generally in the form of islands elongated by the rolling.

The bending capacity was quantified in the following manner: sheets were bent back on themselves several times. In this way, the bending radius gets smaller each time. The bending capacity is then evaluated by noting the presence of cracks at the surface of the folded block, the score being expressed from 1 (low bending capacity) to 5 (very good capacity). Results which scored 1-2 are considered unsatisfactory.

TABLE 4

Results obtained on cold-rolled and annealed sheets

| Steel sheet | Ferrite fraction (%) | Bainite fraction (%) | Martensite fraction (%) | Non-recrystallized ferrite fraction (%) | Re (MPa) | Rm (MPa) | Re/Rm | A (%) | Bending capacity |
|---|---|---|---|---|---|---|---|---|---|
| IX1 Invention | 50 | 6 | 44 | 0 | 720 | 1020 | 0.71 | 11 | 3 |
| IX2 Invention | 52 | 2 | 46 | 0 | 680 | 1030 | 0.66 | 10 | 3 |
| IX3 reference | 48 | 0 | 52 | 25 | 700 | 1120 | 0.62 | 8 | 1 |
| IX4 Invention | 50 | 8 | 42 | 0 | 760 | 1030 | 0.74 | 10 | 3 |
| IX5 reference | 55 | 12 | 33 | 0 | 780 | 950 | 0.82 | 12 | 3 |
| IX6 reference | 46 | 1 | 53 | 20 | 750 | 1130 | 0.66 | 7 | 1 |
| IX7 reference | 56 | 11 | 33 | 0 | 755 | 955 | 0.79 | 12 | 3 |
| IY1 Example | 52 | 2 | 46 | 0 | 650 | 1030 | 0.63 | 13 | 4 |
| IY2 Example | 50 | 7 | 43 | 0 | 680 | 1020 | 0.67 | 12 | 4 |
| IZ Example | 48 | 6 | 46 | 0 | 630 | 1025 | 0.61 | 14 | 4 |
| R reference | 72 | 3 | 25 | 0 | 490 | 810 | 0.60 | 18 | 2 |

Values underlined: not according to the invention

The steel sheets according to the invention have a set of microstructural and mechanical characteristics which enable the advantageous manufacture of parts, especially for structural applications: strength between 980 and 1100 MPa, ratio Re/Rm between 0.6 and 0.8, breaking elongation greater than 9%, good bending capacity. FIG. 1 illustrates the morphology of the steel sheet IX1, in which all the ferrite is recrystallized.

The sheets according to the invention have good weldability, especially by resistance spot welding, the carbon equivalent being less than 0.25. In particular, the spot-welding weldability current range, as defined by the IS018278-2 standard, is very wide, of the order of 3500 A. It is increased compared with a reference steel of the same grade. Also, cross-tensile tests or shear-tensile tests carried out on spot welds on sheets according to the invention reveal that the strength of these spot welds is very high in terms of mechanical properties.

By comparison, the reference sheets do not provide the same characteristics: The steel sheets IX3 (galvanized) and IX6 (galvannealed) were annealed at too low a temperature TM: consequently, the non-recrystallized ferrite fraction is excessive as well as the martensite fraction. These microstructural characteristics are associated with reduced elongation and bending capacity.

Figure 2:
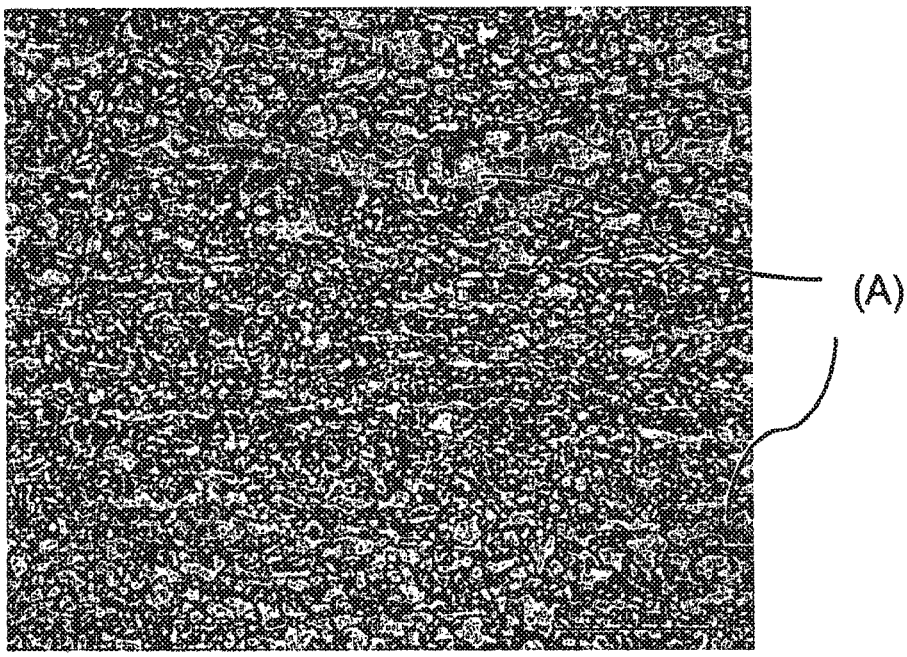
FIGS. 2 and 3 show examples of microstructures of steel sheets which are not according to the invention.
Figure 3:
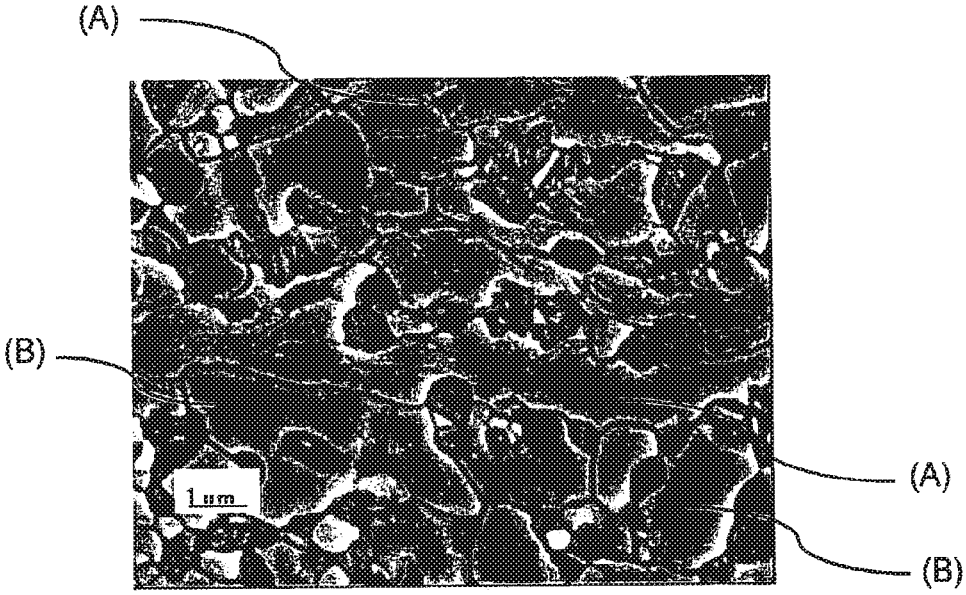

FIG. 2 illustrates the microstructure of the steel sheet IX3: note the presence of non-recrystallized ferrite in the form of elongated islands (marked (A)) coexisting with recrystallized ferrite and martensite, the latter component appearing darker in the micrograph. A Scanning Electronic Microscopy micrograph (FIG. 3) clearly differentiates the zones of non-recrystallized ferrite (A) from the recrystallized ones (B).

Sheet IX5 is a galvannealed sheet annealed at too high a temperature TM: the carbon content of the austenite at high temperature is then too low and the appearance of bainite is promoted to the detriment of the formation of martensite. There is also coalescence of the niobium precipitates, which causes a loss of hardening. The strength is then unsatisfactory, the ratio Re/Rm being too high.

The galvannealed sheet IX7 was cooled at too slow a rate $V_R$ after the annealing step: the transformation of the austenite formed to ferrite during this cooling step is then excessive, the steel sheet containing in the final stage too high a bainite fraction and too low a martensite fraction, which results in unsatisfactory strength.

The composition of the steel sheet R does not correspond to the invention, its carbon content being too high, and its manganese, aluminum, niobium, titanium, and boron contents being too low. Consequently, the martensite fraction is so low that the mechanical strength is unsatisfactory.

The steel sheets according to the invention will be beneficially used for the manufacture of structural or safety parts in the automobile industry.

What is claimed is:

1. A cold-rolled and annealed Dual-Phase steel sheet comprising:

a composition comprising, the contents being expressed by weight:

$0.055\% \leq C \leq 0.095\%$;

$2\% \leq Mn \leq 2.6\%$;

$0.005\% \leq Si \leq 0.35\%$;

$S \leq 0.005\%$;

$P \leq 0.050\%$;

$0.1 \leq Al \leq 0.3\%$;

$0.05\% \leq Mo \leq 0.25\%$;

$0.2\% \leq Cr \leq 0.5\%$;

$Cr+2Mo \leq 0.6\%$;

$Ni \leq 0.1\%$;

$0.010 \leq Nb \leq 0.040\%$;

$0.010 \leq Ti \leq 0.050\%$;

$0.0005 \leq B \leq 0.0025\%$; and $0.002\% \leq N \leq 0.007\%$;

a remainder of the composition comprising iron and the inevitable impurities resulting from smelting;

a tensile strength between 980 and 1100 MPa; and a microstructure consisting of 40 to 65% ferrite, 35 to 50% martensite and 0 to 10% bainite, a non-recrystallized ferrite fraction being less than or equal to 15%.

2. The steel sheet as recited in claim 1, wherein the composition of the steel contains, the content being expressed by weight: $0.12\% \leq Al \leq 0.25\%$.

3. The steel sheet as recited in claim 1, wherein the composition of the steel contains, the content being expressed by weight: $0.10\% \leq Si \leq 0.30\%$.

4. The steel sheet as recited in claim 1, wherein the composition of the steel contains, the content being expressed by weight: $0.15\% \leq Si \leq 0.28\%$.

5. The steel sheet as recited in claim 1, wherein the composition of the steel contains, the content being expressed by weight: P≤0.015%.

6. The steel sheet as recited in claim 1, wherein a microstructure of the steel sheet includes a surface area fraction of 35 to 50% martensite.

7. The steel sheet as recited in claim 6, wherein a remainder of the microstructure consists of a surface area fraction of 50 to 65% ferrite.

8. The steel sheet as recited in claim 6, wherein a remainder of the microstructure consists of surface area fractions of 1 to 10% bainite and 40 to 64% ferrite.

9. The steel sheet as recited in claim 1, wherein a remainder of the microstructure consists of martensite and ferrite.

10. The steel sheet as recited in claim 1, wherein a ratio of yield strength Re to strength Rm is such that: 0.6≤Re/Rm≤0.8.

11. The steel sheet as recited in claim 1, wherein the steel sheet is continuously galvanized.

12. The steel sheet as recited in claim 1, further comprising a galvannealed coating.

13. A structural or safety part for a motor vehicle comprising:

the steel sheet as recited in claim 1.

14. The steel sheet as recited in claim 1, wherein the composition consists of:

0.055%≤C≤0.095%;

2%≤Mn≤2.6%;

0.005%≤Si≤0.35%;

S≤0.005%;

P≤0.050%;

0.1≤Al≤0.3%;

0.05%≤Mo≤0.25%;

0.2%≤Cr≤0.5%;

Cr+2Mo≤0.6%;

Ni≤0.1%;

0.010≤Nb≤0.040%;

0.010≤Ti≤0.050%;

0.0005≤B≤0.0025%; and 0.002%≤N≤0.007%;

the remainder of the composition consisting of iron and the inevitable impurities resulting from smelting.

15. The steel sheet as recited in claim 1, wherein the composition consists of:

0.055%≤C≤0.095%;

2%≤Mn≤2.6%;

0.15%≤Si≤0.28%;

S≤0.005%;

P≤0.015%;

0.12≤Al≤0.25%;

0.05%≤Mo≤0.25%;

0.2%≤Cr≤0.5%;

Cr+2Mo≤0.6%;

Ni≤0.1%;

0.010≤Nb≤0.040%;

0.010≤Ti≤0.050%;

0.0005≤B≤0.0025%; and 0.002%≤N≤0.007%;

the remainder of the composition consisting of iron and the inevitable impurities resulting from smelting.

16. The steel sheet as recited in claim 1, wherein the tensile strength is from 1020 to 1030 MPa and wherein the elongation is from 10 to 14%.

17. The steel sheet as recited in claim 16, wherein the microstructure includes 42 to 46% martensite.

18. The steel sheet as recited in claim 1, wherein all of the ferrite in the microstructure is recrystallized ferrite.

19. The steel sheet as recited in claim 1, wherein the microstructure consists of ferrite, 42 to 46% martensite and up to 8% bainite.

20. The steel sheet as recited in claim 1, wherein the steel sheet is annealed at a temperature from 780 to 800° C. for 90 to 100 seconds.

21. The steel sheet as recited in claim 1, wherein the steel sheet is heated at 2° C./s to an annealing temperature from 780 to 800° C. and annealed for 90 to 100 seconds.

22. The steel sheet as recited in claim 1, wherein the steel sheet is cooled at a rate from 17 to 20° C./s after annealing.

23. The steel sheet as recited in claim 1, wherein 0.38%≤Cr+2Mo≤0.512%.

24. The steel sheet as recited in claim 1, wherein 0.27%≤Cr≤0.33%.

25. The steel sheet as recited in claim 24, wherein 0.055%≤Mo≤0.104%.

26. The steel sheet as recited in claim 25, wherein 0.062%≤C≤0.076%.

27. The steel sheet as recited in claim 1, wherein 0.062%≤C≤0.076%.

28. The steel sheet as recited in claim 1, wherein the martensite comprises islands of average size less than four microns.

29. The steel sheet as recited in claim 28, wherein at least 50% of the islands have a ratio of their maximum dimension Lmax to their minimum dimension Lmin of less than or equal to 2.

30. The steel sheet as recited in claim 1, wherein the martensite comprises islands of average size less than two microns, and at least 50% of the islands have a ratio of their maximum dimension Lmax to their minimum dimension Lmin of less than or equal to 2.

31. The steel sheet as recited in claim 1, wherein the non-recrystallized ferrite fraction is 0%.

* * * * *